US011345581B2

(12) United States Patent
Cook

(10) Patent No.: US 11,345,581 B2
(45) Date of Patent: May 31, 2022

(54) ALCOHOLIC BEVERAGE DISPENSERS WITH FLOW CONTROLS

(71) Applicant: Cornelius Beverage Technologies Limited, West Yorkshire (GB)

(72) Inventor: Christopher Michael Cook, Worcestershire (GB)

(73) Assignee: Cornelius Beverage Technologies Limited, West Yorkshire (GB)

( * ) Notice: Subject to any disclaimer, the term of this patent is extended or adjusted under 35 U.S.C. 154(b) by 0 days.

(21) Appl. No.: 16/919,766

(22) Filed: Jul. 2, 2020

(65) Prior Publication Data

US 2020/0331743 A1 Oct. 22, 2020

Related U.S. Application Data

(63) Continuation of application No. 16/432,520, filed on Jun. 5, 2019, now Pat. No. 10,730,735.
(Continued)

(51) Int. Cl.
*B67D 1/00* (2006.01)
*B67D 1/12* (2006.01)
(Continued)

(52) U.S. Cl.
CPC ..... *B67D 1/0016* (2013.01); *B67D 1/0035* (2013.01); *B67D 1/0046* (2013.01);
(Continued)

(58) Field of Classification Search
CPC ..... B67D 1/0016; B67D 1/1281; B67D 2001/0093; B67D 2001/0097;
(Continued)

(56) References Cited

U.S. PATENT DOCUMENTS 3,348,737 A 10/1967 Yingst et al.
3,386,261 A 6/1968 Cornelius
(Continued)

FOREIGN PATENT DOCUMENTS

EP 152283 8/1985
WO 1992/021607 12/1992
(Continued)

OTHER PUBLICATIONS

International Search Report, PCT/IB2017/056920, dated Feb. 9, 2018.
(Continued)

*Primary Examiner* — Frederick C Nicolas
(74) *Attorney, Agent, or Firm* — Andrus Intellectual Property Law, LLP

(57) ABSTRACT

A beverage dispenser includes a gas infusion device configured to infuse a gas into a base liquid to form a gas-infused liquid, a mixing chamber configured to mix the gas-infused liquid and a concentrate to thereby form a reconstituted beverage, a first flow control configured to decrease pressure of the gas-infused liquid prior to mixing with the concentrate, and a second flow control configured to decrease pressure of the concentrate prior to mixing with the gas-infused liquid. A restrictor device downstream from the mixing chamber and configured to apply backpressure on the concentrate and the gas-infused liquid, and a dispensing valve is configured to dispense the reconstituted beverage.

20 Claims, 7 Drawing Sheets

Related U.S. Application Data

(60) Provisional application No. 62/735,606, filed on Sep. 24, 2018.

(51) Int. Cl.
*B67D 1/08* (2006.01)
*B67D 1/07* (2006.01)

(52) U.S. Cl.
CPC ..... *B67D 1/0884* (2013.01); *B67D 1/0888* (2013.01); *B67D 1/1204* (2013.01); *B67D 1/1252* (2013.01); *B67D 1/1281* (2013.01); *B67D 1/1284* (2013.01); *B67D 1/0068* (2013.01); *B67D 1/07* (2013.01); *B67D 1/0864* (2013.01); *B67D 1/0867* (2013.01); *B67D 2001/0093* (2013.01); *B67D 2001/0096* (2013.01); *B67D 2001/0097* (2013.01); *B67D 2210/00007* (2013.01)

(58) Field of Classification Search
CPC .. B67D 1/0035; B67D 1/0046; B67D 1/0884; B67D 1/0888; B67D 1/1204; B67D 1/1252; B67D 1/1284; B67D 1/0068; B67D 1/07; B67D 1/0864; B67D 1/0867; B67D 2001/0096; B67D 2210/00007
See application file for complete search history.

(56) References Cited

U.S. PATENT DOCUMENTS

| | | | |
|---|---|---|---|
| 3,582,351 | A | 6/1971 | Austin et al. |
| 3,634,107 | A | 1/1972 | Cornelius |
| 3,851,797 | A | 12/1974 | Jacobs |
| 4,493,441 | A | 1/1985 | Sedam et al. |
| 4,708,827 | A | 11/1987 | McMillin |
| 4,745,853 | A | 5/1988 | Hoover |
| 4,967,936 | A | 11/1990 | Bingler |
| 5,021,250 | A | 6/1991 | Ferguson |
| 5,085,810 | A | 2/1992 | Burrows |
| 5,411,179 | A | 5/1995 | Oyler et al. |
| 5,537,914 | A | 7/1996 | Gibney et al. |
| 5,556,006 | A | 9/1996 | Sano |
| 5,565,149 | A | 10/1996 | Page et al. |
| 5,706,661 | A | 1/1998 | Frank |
| 5,738,248 | A | 4/1998 | Green |
| 5,845,815 | A | 12/1998 | Vogel |
| 6,045,007 | A | 4/2000 | Simmons |
| 6,260,477 | B1 | 7/2001 | Tuyls et al. |
| 6,505,758 | B2 | 1/2003 | Black |
| 6,644,508 | B2 | 11/2003 | Haskayne |
| 6,685,054 | B2 | 2/2004 | Kameyama |
| 6,712,342 | B2 | 3/2004 | Bosko |
| 8,485,394 | B2 | 7/2013 | Tachibana |
| 8,540,120 | B2 | 9/2013 | Newton et al. |
| 9,146,564 | B2 | 9/2015 | Winkler |
| 9,623,383 | B1 | 4/2017 | Kleinrichert |
| 9,630,826 | B2 | 4/2017 | Green et al. |
| 10,017,372 | B2 | 7/2018 | Bethuy et al. |
| 10,252,900 | B2 | 4/2019 | Cook |
| 2002/0113087 | A1 | 8/2002 | Ziesel |
| 2005/0072800 | A1 | 4/2005 | Smith |
| 2010/0163572 | A1 | 7/2010 | Downham |
| 2013/0251868 | A1 | 9/2013 | Wells |
| 2016/0368752 | A1 | 12/2016 | Bethuy et al. |
| 2018/0155176 | A1 | 6/2018 | Cook |
| 2020/0095108 | A1* | 3/2020 | Cook ..... B67D 1/1284 |

FOREIGN PATENT DOCUMENTS

| | | |
|---|---|---|
| WO | 2016083482 | 6/2016 |
| WO | 2018104810 | 6/2018 |

OTHER PUBLICATIONS

Written Opinion, PCT/IB2017/056920, dated Feb. 9, 2018.
International Search Report and Written Opinion for PCT/US2019/054990, dated Sep. 30, 2019.

* cited by examiner

ALCOHOLIC BEVERAGE DISPENSERS WITH FLOW CONTROLS

CROSS-REFERENCE TO RELATED APPLICATION

The present application is a continuation of U.S. application Ser. No. 16/432,520, filed Jun. 5, 2019, which claims priority to U.S. Provisional Patent Application No. 62/735,606 filed Sep. 24, 2018, both of which applications are hereby incorporated by reference in their entirety.

FIELD

The present disclosure relates to beverage dispensers that combine one or more liquids to form a mixed beverage and specifically relates to beverage dispensers with flow controls that dispense a gas-infused liquid and an alcoholic concentrate to form an alcoholic beverage.

BACKGROUND

The following U.S. Patent and U.S. Patent Application are incorporated herein by reference, in entirety:

U.S. Pat. No. 5,845,815 discloses a piston based flow control for use in a high flow beverage dispensing valve. The piston includes a top perimeter edge structure that allows for continuity of liquid flow during high flow applications and particularly during the initiation of a high flow dispensing so as to eliminate chattering of the piston.

U.S. Patent Application Publication No. 2018/0155176 discloses a beverage dispenser that includes a gas infusion device that receives a base fluid and a gas and dispenses a gas infused liquid, a ratio pump that receives the gas infused liquid and a concentrate from a concentrate source and dispenses a predetermined ratio of the gas infused liquid and the concentrate, and a mixing chamber that mixes the predetermined ratio of the gas infused liquid and the concentrate to form a reconstituted beverage.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a beverage dispenser includes a gas infusion device configured to infuse a gas into a base liquid to form a gas-infused liquid, a mixing chamber configured to mix the gas-infused liquid and a concentrate to thereby form a reconstituted beverage, a first flow control configured to decrease pressure of the gas-infused liquid prior to mixing with the concentrate, and a second flow control configured to decrease pressure of the concentrate prior to mixing with the gas-infused liquid. A restrictor device downstream from the mixing chamber and configured to apply backpressure on the concentrate and the gas-infused liquid, and a dispensing valve is configured to dispense the reconstituted beverage.

In certain examples, a method of dispensing a reconstituted beverage includes the steps of: infusing a gas into a base liquid to thereby form a gas-infused liquid; mixing, in a mixing chamber, the gas-infused liquid and a concentrate to thereby form a reconstituted beverage; decreasing, with a first flow control, pressure of the gas-infused liquid prior to the mixing of the gas-infused liquid and the concentrate; decreasing, with a second flow control, the pressure of the concentrate prior to the mixing of the gas-infused liquid and the concentrate; applying, with a first restrictor device positioned downstream from the mixing chamber, backpressure on the concentrate and the gas-infused liquid; and dispensing the reconstituted beverage via a first dispensing valve.

Various other features, objects, and advantages will be made apparent from the following description taken together with the drawings.

BRIEF DESCRIPTION OF THE DRAWINGS

Examples of the present disclosure are described with reference to the following drawing figures. The same numbers are used throughout the drawing figures to reference like features and components.

DETAILED DESCRIPTION

Reconstituting alcoholic beverages (e.g., beer, alcoholic ciders) from an alcoholic concentrate and a base liquid (e.g., still water) or a gas-infused liquid is becoming increasingly popular in many pubs and/or restaurants as a way of minimizing the space needed to store multiple mixed beverages. That is, a relatively large number of alcoholic concentrates can be stored in a small space (in contrast to the large space needed to store large, conventional kegs containing alcoholic beverages) and combined with a local water source to form a mixed or reconstituted beverage on-location and on-demand for the consumer. Furthermore, reconstituting alcoholic beverages on-site can minimize the cost of transporting heavy cans, bottles, and/or kegs containing alcoholic beverages.

Through research and experimentation, the present inventor has endeavored to develop improved apparatuses, systems, and methods for reconstituting and dispensing reconstituted alcoholic beverages formed from a gas-infused liquid and an alcoholic concentrate.

Figure 1:
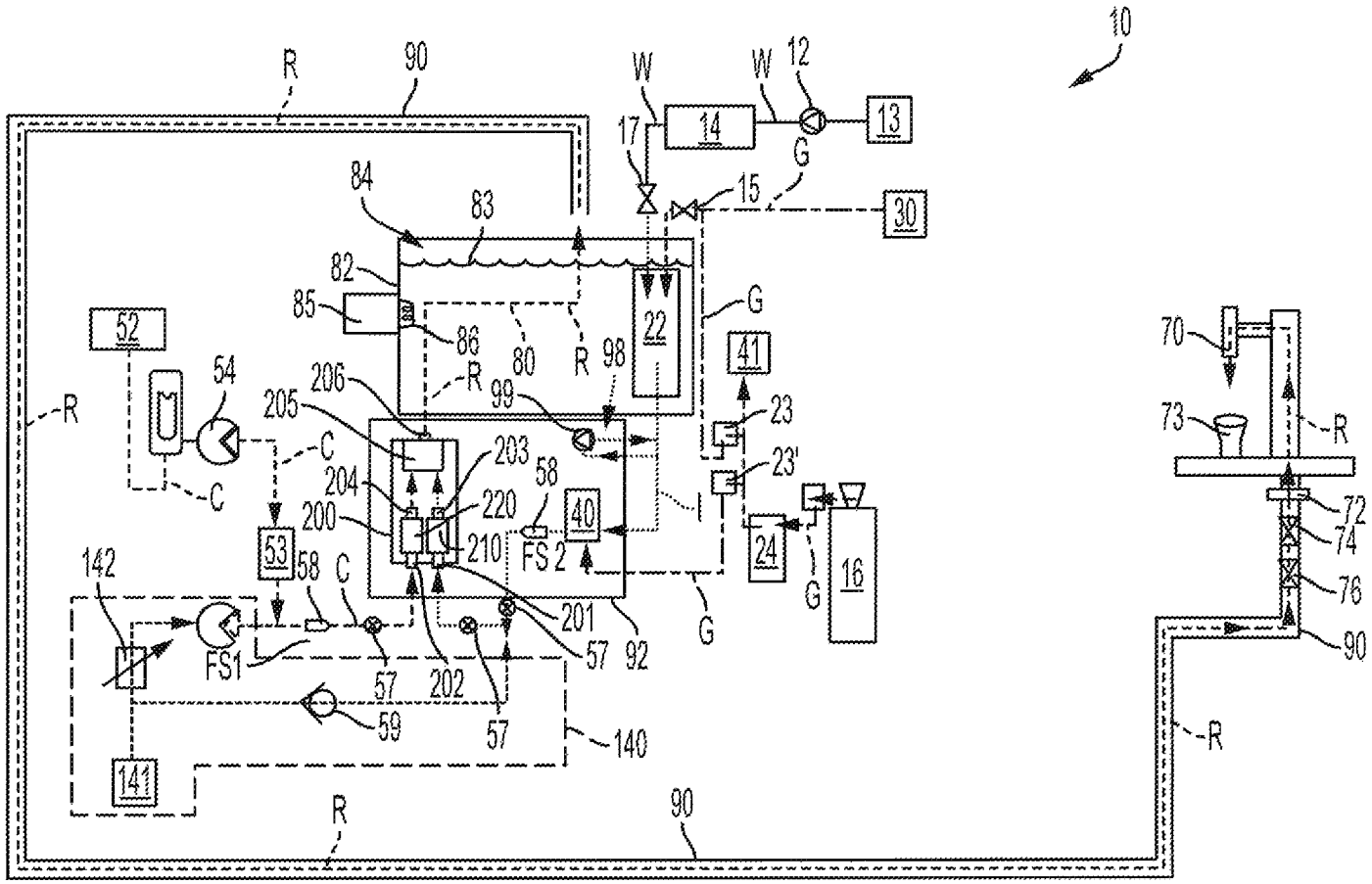
FIG. 1 is a schematic diagram of an example beverage dispenser according to the present disclosure.

FIG. 1 depicts a schematic diagram of an example beverage dispenser 10 according to the present disclosure. The beverage dispenser 10 includes a base liquid inlet 12 that receives a base liquid (e.g., drinking water, filtered drinking water, water-syrup solution) from a base liquid source 13 (e.g., water tank, pressurized water tank, municipal water source) (note that pipes or conduits through which the base liquid is conveyed are labeled W). The base liquid can be modified to suit the requirements of the finished or reconstituted beverage. That is, the base liquid can be filtered, purified, or fortified such that the chemical composition of the base liquid closely matches the base liquid used by the original manufacturer (e.g., brewery) to make or form the original, non-concentrate finished beverage (e.g., beer). For example, the base liquid can be modified by water filtration devices, reverse osmosis (RO) water processing stations, blending devices, and the like to "normalize" geographically different base liquids and thereby decrease the variability and increase the quality of the reconstituted beverage formed and dispensed from the beverage dispenser 10.

The base liquid is cooled by a base liquid cooling or refrigeration system 14 to a suitable or predetermined temperature before being conveyed to a gas infusion device 22 (described herein). The refrigeration system 14 can be any suitable type of refrigeration system that is commonly used in the industry. For example, the refrigeration system can be an air-cooled system, a water-cooled system, an ice-bank based cooling system, or a combination system thereof. A valve 17 is included to control the flow of the base liquid to the gas infusion device (e.g., the valve 17 can be opened and closed to thereby control the flow of the base liquid).

The beverage dispenser 10 also includes a gas inlet 15 that receives a pressurized gas (e.g., CO2, N2, O2, mixed gas) from a gas source 16 (e.g. gas tank, compressor) (note that pipes or conduits through which the gas is conveyed are labeled G). In certain examples, the gas inlet 15 is a gas inlet valve. The gas received via the gas inlet 15 is infused into the base liquid with the gas infusion device 22, such as a carbonator or gas sparger, to thereby form a gas-infused liquid (described hereinbelow in greater detail) (note that pipes or conduits through which gas-infused liquid is conveyed are labeled I). The gas can be modified to suit the requirements of a finished or reconstituted beverage (e.g., the gas may be filtered) such that the composition of the gas closely matches the gas of the original, non-concentrate finished beverage. For example, the gas can be modified by gas filtration devices, gas lending devices, and the like to "normalize" geographically different gas sources and thereby decrease the variability and increase the quality of the reconstituted beverage that is formed and dispensed from the beverage dispenser 10. For example, a gas filtration device 24 can be included to filter the gas to closely match the gas in the original, non-concentrate finished beverage. The type of gas filtration device 24 can vary and may include a taste filter and/or odors filter. An example of a conventional gas filtration device is manufactured by Parker Dominic Hunter (model number MD-2).

Gas regulator(s) 23 are included so that an operator can regulate the flow of the gas to the gas infusion device 22 and/or isolate the gas source 16 from the rest of the beverage dispenser 10. In certain examples, an auto-vent device 30 is included and is configured to vent excess gas from the gas infusion device 22 and/or lower the pressure of the gas when the pressure in the gas infusion device 22 exceeds a predetermined maximum pressure limit or value. In certain examples, a gas-line cleaning assembly 41 is included for cleaning the pipes or conduits through which the gas is conveyed.

A boost pump 40 receives the gas-infused liquid from the gas infusion device 22 and is configured to increase the pressure of the gas-infused liquid such that the gas remains in solution and does not "breakout" of the base liquid. In one example, the boost pump 40 increases the pressure of the gas-infused liquid to a pressure (e.g., predetermined upstream pressure) in the range of 10.0-100.0 pounds per square inch (PSI), preferably in the range of 40.0-65.0 PSI, and more preferably to 60.0 PSI, from 31.0 PSI which is the pressure at which the gas-infused liquid dispenses from the gas infusion device 22. Note that the pressure at which the gas-infused liquid dispenses from the gas infusion device 22 may vary based on the type of gas infusion device 22. The boost pump 40 is connected to the gas source 16 via a gas regulator 23'. A person of ordinary skill in the art will recognize that the pressure of the gas-infused liquid and/or the concentrate may be changed (e.g., increased, decreased) to any selected pressure within the pressure range of above 10.0-100.0 PSI (e.g., 15.0 PSI, 40.0 PSI, 45.0 PSI, 60.0 PSI, 61.0 PSI, 85.0 PSI).

The alcoholic concentrate is conveyed by a pump 53 from a concentrate source 52 such as a tank or bag-in-box container (note that pipes or conduits through which the alcoholic concentrate is conveyed are labeled C). A valve 54 is provided to control the flow of the alcoholic concentrate pumped from the concentrate source 52. In the example depicted in FIG. 1, solenoid valves 57 are included to selectively close and thereby stop the flow of the alcoholic concentrate and/or the gas-infused liquid to the beverage dispenser 10 in the event power to the beverage dispenser 10 is interrupted. In certain examples, flow sensors 58 are included to sense the flow of the alcoholic concentrate and the gas-infused liquid and send signals to a controller 116 (see FIG. 5) which is configured to control operations of the beverage dispenser 10. In certain examples, check valves 59 can be included to prevent the gas-infused liquid and/or the alcoholic concentrate from inadvertently flowing into different sections of the beverage dispenser 10.

The type of alcoholic concentrate that can be used with the beverage dispensers 10 of the present disclosure may vary. That is, alcoholic concentrates with different fluid properties and/or the material compositions may be used with the beverage dispensers 10 of the present disclosure. For example, the alcoholic concentrate can have a viscosity in the range of 1.0-40.0 centipoise (cP). Preferably, the alcoholic concentrate has a viscosity in the range of 3.0-20.0 cP. In other examples, the alcoholic concentrate has a viscosity in the range of 1.0-15.0 cP, 2.0-17.0 cP, or 8.0-23.0 cP, 4.0-7.0 cP, 23.0-38.0 cP, or any combination thereof. In other examples, the alcoholic concentrate can have an alcohol by volume (ABV) in the range of 2.0-45.0%. Preferably, the alcoholic concentrate has an ABV in the range of 15.0-30.0%. In some embodiments, the concentrate has an ABV in the range of 5.0-10.0%, 10.0-20.0%, 15.0-25.0%, 20.0-39.0%, or 21.0-24.0%, or any combination thereof.

The beverage dispenser 10 includes a flow control block 200 that includes one or more flow controls 210, 220 (described herein) that receive the gas-infused liquid and the alcoholic concentrate, respectively, and dispense the gas-infused liquid and the alcoholic concentrate at preselected flow rates, respectively, such that the gas-infused liquid and the concentrate mix to form the reconstituted beverage (note that the pipes or conduits through which the reconstituted beverage is conveyed are labeled R). In particular, the gas-infused liquid and the alcoholic concentrate are mixed to form the reconstituted beverage at a predetermined fluid ratio of the gas-infused liquid and the alcoholic concentrate (e.g., 2:1, 3:1, 5:1, 7:1, 10:1, 20:1). In one example, the first flow control 210 dispenses the gas-infused liquid at a first flow rate (e.g., 1.0 ounces per second) and the second flow control dispenses the alcoholic concentrate at a second flow rate (e.g., 0.2 ounces per second) such that the reconstituted beverage is formed with a predetermined fluid ratio (e.g., 5:1).

The flow control block 200 has a first inlet 201 that receives the gas-infused liquid and a second inlet 202 that receives the alcoholic concentrate. The gas-infused liquid is conveyed through the first flow control 210 and dispensed from a first outlet 203 to a mixing chamber 205. The first flow control 210 decreases the pressure of the gas-infused liquid as the gas-infused liquid is conveyed therethrough. Similarly, the alcoholic concentrate is conveyed through the second flow control 220 and dispensed from a second outlet 204 to the mixing chamber 205. The second flow control 220 decreases the pressure of the alcoholic concentrate as the alcoholic concentrate is conveyed therethrough. In certain examples, the outlets 203, 204 are one-way or check valves. The mixing chamber 205 is configured to mix the gas-infused liquid and the alcoholic concentrate to form the reconstituted beverage. The mixing chamber 205 has an outlet 206 through which the reconstituted beverage is dispensed. In the example depicted in FIG. 1, the flow control block 200 is positioned in an insulated enclosure 92 and cooled by a cooling or refrigeration system (not shown). In certain examples, the mixing chamber 205 is a Y-shaped channel with a pair of upstream inlet ends and a downstream outlet end. In certain examples, the gas-infused liquid is conveyed from the gas infusion device 22 though a circulation loop 98 in the insulated enclosure 92 before the gas-infused liquid is conveyed to the boost pump 40. As such, the gas infused-liquid conveyed through the circulation loop 98 cools the components located into the insulated enclosure 92. The circulation loop 98 includes a circulation valve 99 that is selectively opened and closed.

The reconstituted beverage is further conveyed into and through a beverage cooling coil 80 positioned in a cooling tank 82 that defines a cavity 84 into which a cooling media 83 is received and contained. A cooling or refrigeration system 85, which may be remote to the cooling tank 82, cools the cooling media 83 and the reconstituted beverage in the beverage cooling coil 80. The refrigeration system 85 can be any suitable type of refrigeration system that is commonly used in the industry such as an "ice bank" system, an air-cooled system, a water-cooled system, or a combination system thereof.

In certain examples, the refrigeration system 85 includes a cooling coil 86 that is positioned in the cooling tank 82 such that the cooling coil 86 contacts the cooling media 83. The refrigeration system 85 also includes a heat exchanger (not shown), a fan (not shown), and a pump (not shown) that circulate a coolant through the cooling coil 86 and the heat exchanger such that heat is transferred from the cooling media 83 via the cooling coil 86 to the coolant and the heat exchanger. In the example depicted, the gas infusion device 22 is positioned in the cavity 84 such that the cooling media 83 contacts and cools the gas infusion device 22 such that the base liquid, the gas, and the gas-infused liquid are cooled.

The reconstituted beverage is further conveyed from the beverage cooling coil 80 to a cooled beverage line 90, such as a python (e.g., conduit or trunking) with an internal cooling media or device (e.g., recirculated coolant, refrigerated tubing), that further cools or maintains the reconstituted beverage at a desired temperature as the reconstituted beverage is conveyed downstream to a dispensing valve 72 and a tap 70. In operation, when an operator opens the dispensing valve 72 the reconstituted beverage is dispensed through the tap 70 to the operator and into a receptacle 73, such as a beer pint glass.

A fixed restrictor 74 and an adjustable restrictor 76 are positioned upstream of the tap 70 and/or the dispensing valve 72, and the restrictors 74, 76 assist in gradually changing (e.g., decreasing) the pressure of the reconstituted beverage as the reconstituted beverage is dispensed through the tap 70. Accordingly, the reconstituted beverage is dispensed with a desired amount of foam or head. The restrictors 74, 76 also apply backpressure upstream on the reconstituted beverage in the beverage dispenser 10 and the gas-infused liquid and the alcoholic concentrate in the flow control block 200 (described further hereinbelow).

In certain examples, the beverage dispenser 10 includes a line cleaning apparatus or assembly 140 that can be integral with or removably coupled to the beverage dispenser 10. The line cleaning assembly 140 dispenses and/or conveys a cleaning solution into the beverage dispenser 10 to clean and flush the conduits and components of the beverage dispenser 10 through which the alcoholic concentrate and the reconstituted beverage are conveyed. The line cleaning assembly 140 can include a vacuum or pressure operated line cleaning pressure control 142 and one or more cleaning liquid sources 141.

Figure 2:
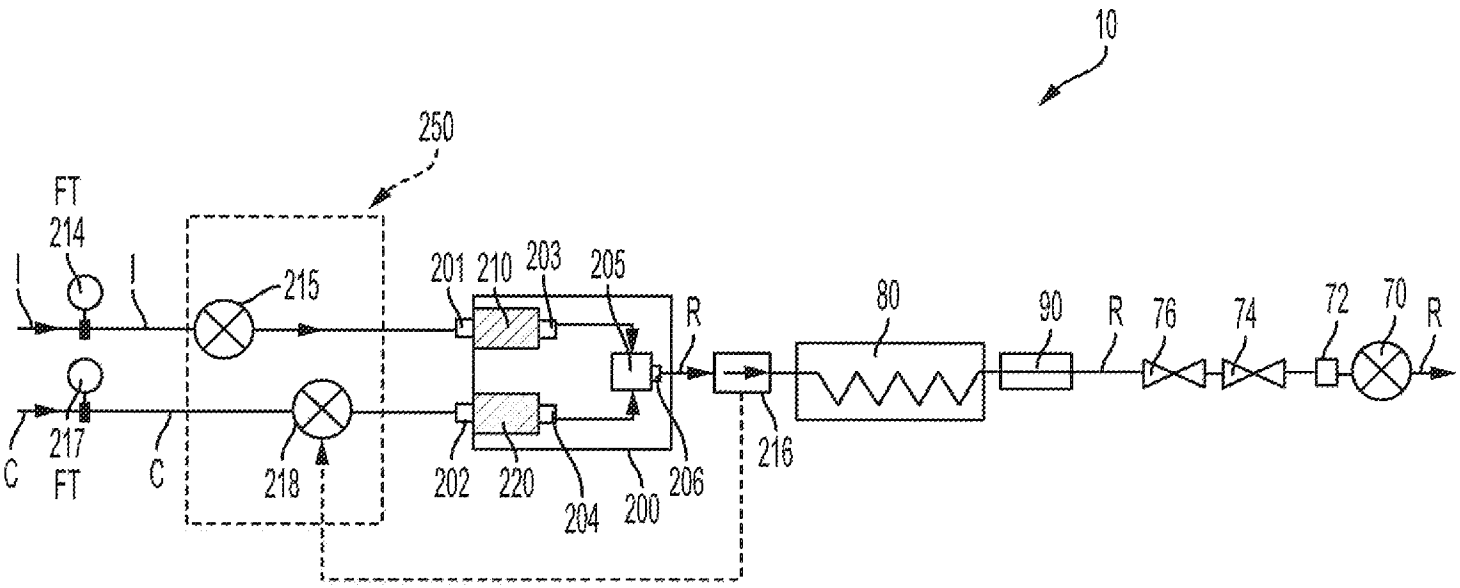
FIG. 2 is a partial schematic diagram of another example beverage dispenser with an example flow control block and related components.
Figure 5:
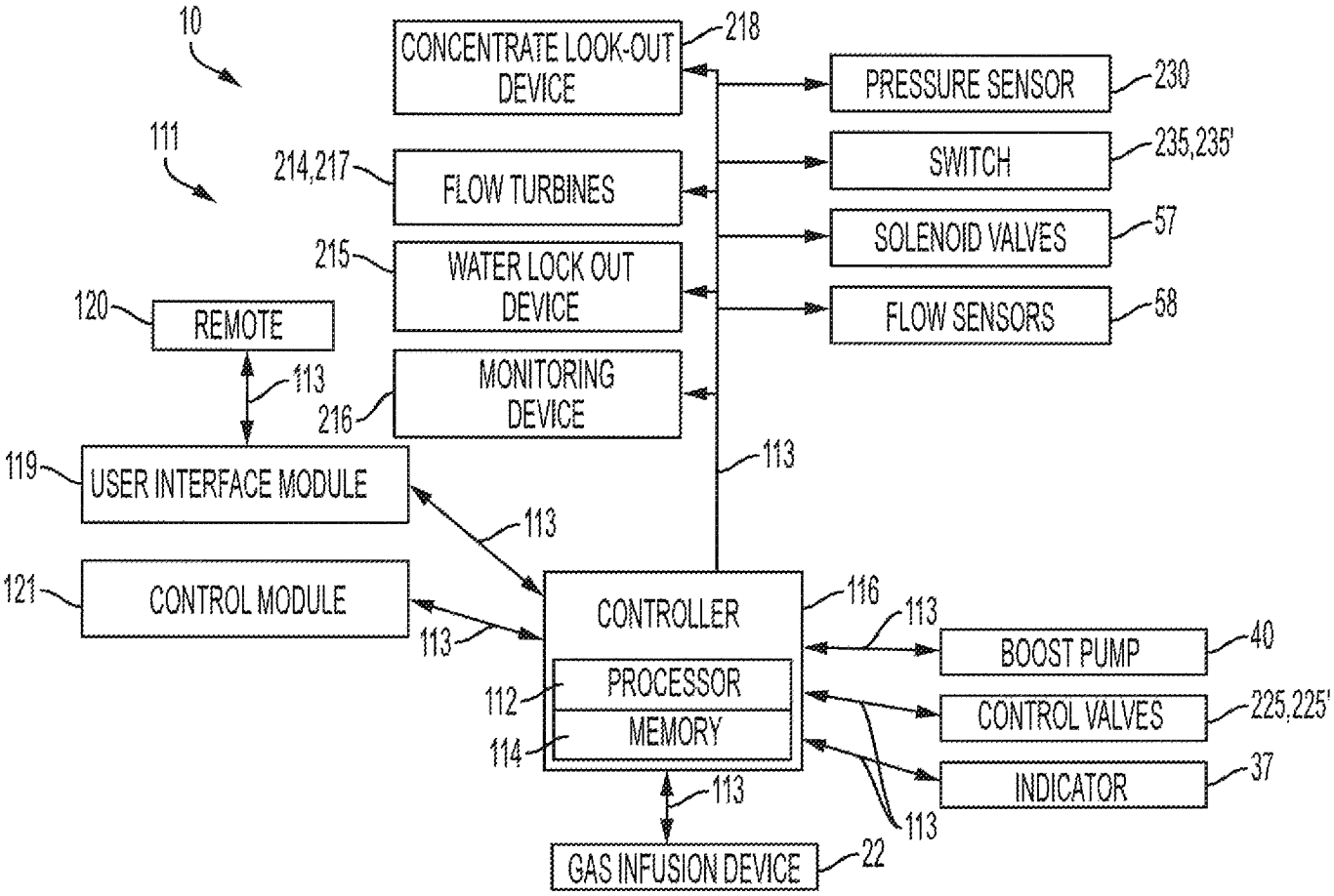
FIG. 5 is a schematic diagram for an example computing system for an example beverage dispenser.

FIG. 2 a partial schematic diagram of the beverage dispenser 10 with an example flow control block 200. The flow control block 200 and related components depicted in FIG. 2 are used with example beverage dispensers 10 having one dispensing valve 72 and/or one tap 70. The gas-infused liquid (labeled as I) is received from the boost pump 40 (see FIG. 1) via a flow turbine 214. The boost pump 40 increases the pressure of the gas-infused liquid to a predetermined upstream pressure (further described herein). The gas-infused liquid is conveyed through a water lockout device 215 to the first inlet 201 of the flow control block 200. Accordingly, the gas-infused liquid is received into the first flow control 210 and dispensed from the first outlet 203 to the mixing chamber 205. In parallel, the alcoholic concentrate (labeled as C) is received via a flow turbine 217. The flow turbines 214, 217 are for monitoring the flow of the gas-infused liquid and the concentrate, respectively, and providing data to a controller 116 (FIG. 5, described herein). The pump 53 (FIG. 1) increases the pressure of the alcoholic concentrate to the predetermined upstream pressure, and the alcoholic concentrate is conveyed through a concentrate lockout device 218 and to the second inlet 202 of the flow control block 200. Accordingly, the alcoholic concentrate is received into the second flow control 220 and dispensed via the second outlet 204 into the mixing chamber 205 where the alcoholic concentrate and the gas-infused liquid mix to form the reconstituted beverage (labeled as R). The reconstituted beverage is then conveyed through a monitoring device 216 (e.g., pressure sensor, flow switch) and to the cooling coil 80. Examples of conventional flow controls are disclosed in above-incorporated U.S. Pat. No. 5,845,815. In one example, the flow control 210, 220 comprising an inlet that receives the liquid (e.g., the gas-infused liquid, the alcoholic concentrate), a chamber in which a sleeve and a piston are positioned, and an outlet that dispenses the liquid. The piston is biased toward a first end of the sleeve with a spring. As the liquid is conveyed via the inlet, the liquid forces the piston toward an opposite, second end of the sleeve such that the spring is compressed. As such, the piston covers (e.g., at least partially) holes defined in the sleeve such that the flow rate of the liquid through the chamber and the holes to the outlet is metered to a predetermined flow rate. The force applied by the spring on the piston can be adjusted to thereby vary the movement of the piston relative to the sleeve when the liquid is conveyed through the flow control. As such, the portion of the holes covered by the piston is adjusted when the liquid is conveyed through the flow control and therefore the flow rate of the liquid is adjusted.

During operation of the beverage dispenser 10, the present inventor has discovered that the pressure differential or pressure decrease of the gas-infused liquid and the alcoholic concentrate across both flow controls 210, 220 must be the same (or substantially the same) so that the flow rates of the gas-infused liquid and the alcoholic concentrate dispensed from the flow controls 210, 220 are sufficient to form the reconstituted beverage with a predetermined ratio (e.g., five parts gas-infused liquid to one part alcoholic concentrate 5:1). For example, if the pressure differential across the flow controls 210, 220 is too low, the flow controls 210, 220 will not correctly operate and therefore the flow rates of the gas-infused liquid and the alcoholic concentrate dispensed from the flow controls 210, 220, respectively, will be incorrect.

To maintain the predetermined pressure differential across the flow controls 210, 220, a predetermined upstream pressure of the gas-infused liquid and the alcoholic concentrate upstream from the flow controls 210, 220 and a predetermined downstream pressure the reconstituted beverage downstream from the flow controls 210, 220 must be controlled and maintained so that the flow controls 210, 220 operate efficiently and effectively. That is, when the predetermined pressure differential across the flow controls 210 is maintained, the flow rates of the gas-infused liquid and alcoholic concentrate dispensed from the flow controls 210, 220, respectively, are at correct, predetermined flow rates such that the reconstituted beverage is formed with the correct fluid ratio.

With regards to the predetermined upstream pressure, the boost pump 40 is configured to increase the pressure of the gas-infused liquid to the predetermined upstream pressure and the pump 53 is configured to increase of the pressure of the alcoholic concentrate to the predetermined upstream pressure, if necessary. In one non-limiting example, the boost pump 40 and the pump 53 increase the pressure of the gas-infused liquid and the alcoholic concentrate respectively to 60.0 PSI. The predetermined downstream pressure is met or maintained by adjusting or "tuning" the backpressure acting on the flow controls 210, 220. As such, the predetermined pressure differential across the flow controls 210, 220 can be achieved. In one non-limiting example, the predetermined pressure differential across the flow controls 210, 220 that results in correct flow rates of the gas-infused liquid and the alcoholic concentrate from the flow controls 210, 220 is 38.0 PSI. However, if the predetermined upstream pressure is 60.0 PSI and the initial predetermined downstream pressure of the reconstituted beverage is 19.0 PSI, the actual, initial pressure differential across the flow controls 210, 220 is 41.0 PSI (60.0 PSI minus 19.0 PSI). Therefore, the backpressure acting on the flow controls 210, 220 is adjusted to 22.0 PSI such that the pressure differential across the flow controls 210, 220 is 38.0 PSI (38.0 PSI is the predetermined pressure differential across the flow controls 210, 220 noted above in this example). Accordingly, the flow rates of the gas-infused liquid and the alcoholic concentrate dispensed from the flow controls 210, 220, respectively, are correct and the gas-infused liquid and the alcoholic concentrate are mixed together to form the reconstituted beverage with the predetermined fluid ratio. In other examples, the predetermined upstream pressure of the gas-infused liquid and/or the concentrate may be at any desired pressure within the range of 10.0-100.0 PSI.

The present inventor has also recognized, through research and experimentation, that the pressure of the reconstituted beverage downstream from the flow control block 200 is influenced or dependent on the distance or length of conduit or pipe between the flow controls 210, 220 and the dispensing valve 72. That is, the greater the distance between the flow controls 210, 220 and the dispensing valve 72 the greater the pressure drop of the reconstituted beverage in the conduit or pipe. To adjust the pressure of the reconstituted beverage to the predetermined downstream pressure, the operator opens the dispensing valve 72 and then adjusts the adjustable restrictor 76 until the pressure of the reconstituted beverage is at the predetermined downstream pressure. As such, the beverage dispenser 10 is calibrated or "tuned" for its specific application and length of conduit or pipe. In one non-example, when the dispensing valve 72 is first opened, the pressure of the reconstituted beverage is 19.0 PSI. The operator then adjusts the pressure of the reconstituted beverage downstream of the flow controls 210, 220 using the adjustable restrictor 76 until the pressure of the reconstituted beverage is at the predetermined downstream pressure (e.g., 22.0 PSI). The present inventor has also recognized that when the dispensing valve 72 is closed the pressures of the gas-infused liquid and the alcoholic concentrate upstream from the flow control block 200 are equal to the pressure of the reconstituted beverage downstream from the flow control block 200.

The use of flow controls 210, 220 in the beverage dispenser 10 of the present disclosure differs from other conventional beverage dispensers that use other devices (e.g., ratio pumps) to dispense the gas-infused liquid and the alcoholic concentrate to form reconstituted beverages. In some of these conventional beverage dispensers, the pressure differential across the components upstream from the dispensing valve are not typically controlled. For example, when a ratio pump is used the ratio pump continuously pumps the predetermined amount of the gas-infused liquid and the alcoholic concentrate regardless of the pressure differential or the backpressure acting on the ratio pump. As such, the pressure differential or the backpressure acting on the ratio pump does not impact the predetermined amount of the gas-infused liquid and the alcoholic concentrate dispensed from the ratio pump.

Figure 3:
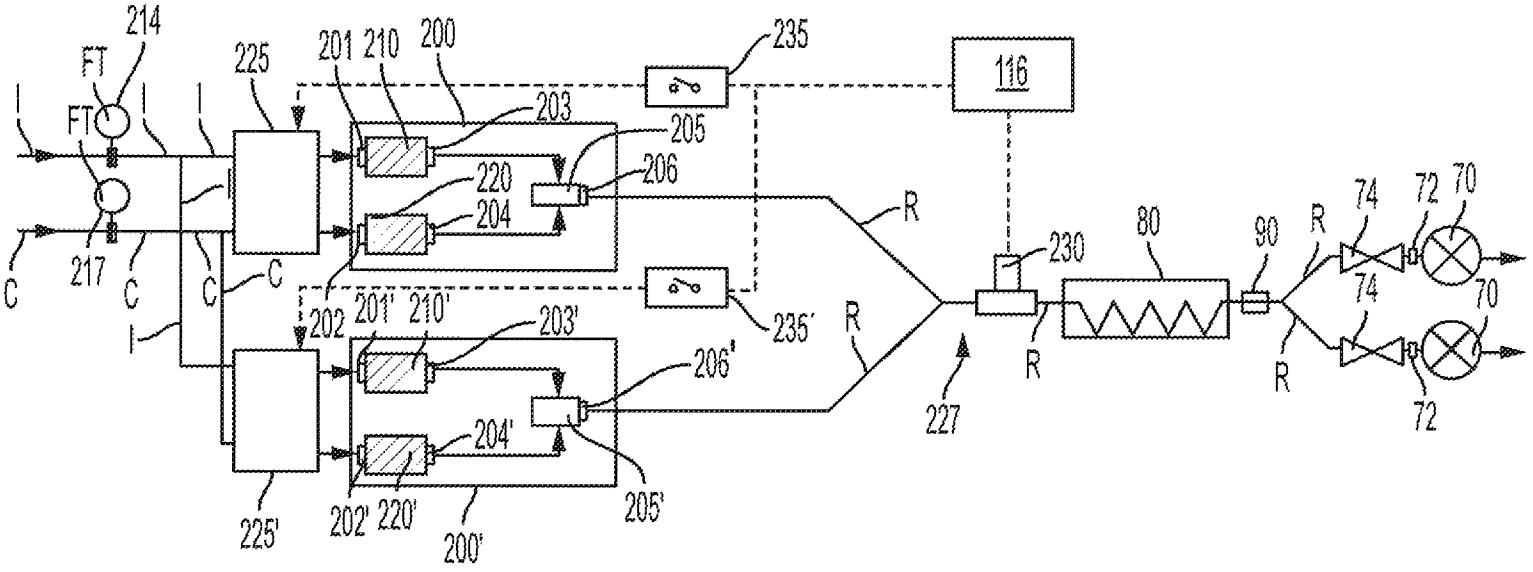
FIG. 3 is a partial schematic diagram of another example beverage dispenser with a first flow control block, a second flow control block, and related components.

Referring now to FIG. 3, a partial schematic diagram of another example beverage dispenser 10 of the present disclosure having a first flow control block 200, a second flow control block 200', and related components is depicted. The flow control blocks 200, 200' and related components depicted in FIG. 3 can be used with a beverage dispenser 10 having more than one dispensing valve 72, such as two dispensing valves 72 and/or two taps 70 (as depicted). Through research and experimentation, the present inventor has observed that when two taps 70 are used to dispense the reconstituted beverage formed from one gas-infused liquid (labeled as I) and one alcoholic concentrate (labeled as C) the pressure of the reconstituted beverage downstream from a single flow control block 200 (see FIG. 2) fluctuates as the two dispensing valves 72 are opened and closed. As such, the pressure differential across the flow controls 210, 220 and the flow rates of the gas-infused liquid and the alcoholic concentrate dispensed from the single flow control block 200 can vary such that the consistency of the reconstituted beverage from the gas-infused liquid and the alcoholic concentrate decreases. Accordingly, through research and experimentation, the present inventor has developed the beverage dispenser 10 described hereinbelow with reference to FIG. 3 that permits multiple dispensing valves 72 and taps 70 (e.g., two dispensing valves 72 and two taps 70) to dispense the same reconstituted beverage.

In the example depicted in FIG. 3, the gas-infused liquid (lines labeled as I) is conveyed through a flow turbine 214 and to a first control valve 225 and a second control valve 225' (e.g., the control valves 225, 225' are twin channel or duplex valves). Similarly, the alcoholic concentrate (lines labeled as C) is conveyed through the flow turbine 217 and to the first control valve 225 and the second control valve 225'. In operation, the control valves 225, 225' are selectively opened (described herein) to thereby permit the gas-infused liquid and the alcoholic concentrate to be conveyed into two flow control blocks 200, 200' such that the reconstituted beverage (lines labeled as R) is formed, dispensed from the flow control blocks 200, 200', and thereby combined into a single flow of the reconstituted beverage (see location 227). A pressure sensor 230 is included downstream from the flow control blocks 200, 200' (e.g., downstream from the combination location 227) and is configured to sense the pressure of the reconstituted beverage in the beverage dispenser 10. The pressure sensor 230 is in communication with the controller 116 which controls (e.g., opens, closes) switches 235, 235' (FIG. 5) to thereby open and close the control valves 225, 225'.

Figure 4:
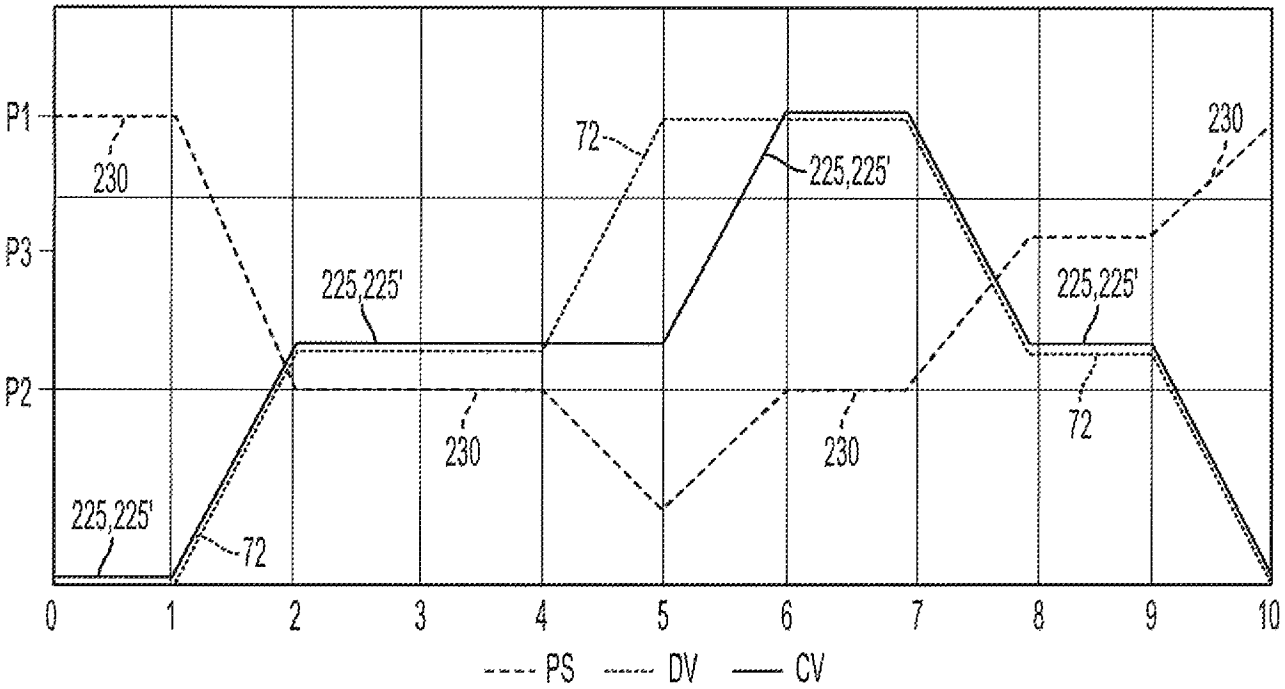
FIG. 4 is an example operating sequence for an example beverage dispenser.

Referring now to FIG. 4, an example operating sequence for an example beverage dispenser 10 is depicted. The dashed line labeled as 230 depicts the relative pressure sensed by the pressure sensor 230, the solid line labeled as 225, 225' depicts the operational status of the two control valves 225, 225', and the dashed line labeled as 72 depicts the operational status of two dispensing valves 72 (see FIG. 3 for these components).

At vertical line 0, the dispensing valves 72 are closed such that the gas-infused liquid, the alcoholic concentrate, and the reconstituted beverage are not conveyed through the beverage dispenser 10. The control valves 225, 225' are also closed. As such, the pressure sensor 230 senses a first predetermined pressure P1 (e.g., a high pressure) of the reconstituted beverage in the beverage dispenser 10. At vertical line 1, one of the dispensing valves 72 begins to open such that the pressure of the reconstituted beverage decreases. As the pressure sensor 230 senses the pressure of the reconstituted beverage decreasing, the pressure sensor 230 generates signals or pressure sensor data that are received by the controller 116 which is configured to close the first switch 235 to thereby open the first control valve 225. Accordingly, the gas-infused liquid and the alcoholic concentrate are dispensed to the first flow control block 200 and the pressure of the reconstituted beverage stabilizes at a second predetermined pressure P2 while the dispensing valve 72 remains open (see at vertical line 2). The second predetermined pressure P2 is sensed by the pressure sensor 230, and the second predetermined pressure is less than the first predetermined pressure.

At vertical line 4, the second dispensing valve 72 is opened such that the reconstituted beverage begins to dispense from the second tap 70. As the second dispensing valve 72 is opened, the pressure of the reconstituted beverage decreases. At vertical line 5, the second dispensing valve 72 is fully open and the controller 116 receives signals from the pressure sensor 230 and closes the second switch 235' to thereby open the second control valve 225'. As such, the gas-infused liquid and the alcoholic concentrate are conveyed to the second flow control block 200', dispensed therefrom, and mixed to form the reconstituted beverage. The reconstituted beverage formed in the second flow control block 200' is further mixed or combined with the reconstituted beverage formed in the first flow control block 200 (see combination location 227 on FIG. 3). As such, the pressure of the reconstituted beverage increases and stabilizes at the second predetermined pressure P2 (at vertical line 6).

Both dispensing valves 72 and both control valves 225, 225' are open until vertical line 7. At vertical line 7, one the dispensing valves 72 begins to close, and as such, the pressure of the reconstituted beverage increases toward an intermediate predetermine pressure P3 between the first predetermined pressure P1 and the second predetermined pressure P2. Accordingly, the controller 116 opens the second switch 235' to thereby close the second control valve 225' and stop the gas-infused liquid and the alcoholic concentrate from being conveyed to the second flow control block 200'. As such, the pressure of the reconstituted beverage stabilizes at the intermediate predetermine pressure P3 (see at vertical line 8). In other examples, the pressure of the reconstituted beverage increases to and is stabilized at the second predetermined pressure P2 when one of the dispensing valves 72 is closed.

At vertical line 9, the remaining open dispensing valve 72 begins to close, and as such the pressure of the reconstituted beverage increases to the first predetermined pressure P1. Accordingly, the controller 116 opens the first switch 235 to thereby close the first control valve 225 to stop flow of the gas-infused liquid and the alcoholic concentrate to the first flow control block 200. When both dispensing valves 72 are closed (see at vertical line 10), the pressure of the reconstituted beverage is at the first predetermined pressure P1 and no liquids are conveyed through or dispensed from the beverage dispenser 10. In this example, the sequential or "staggered" closing of the control valves 225, 225' as the dispensing valves 72 are closed is advantageous to ensure that the pressure of the reconstituted beverage is at the first predetermined pressure P1 when both dispensing valves 72 are closed. In contrast, if both control valves 225, 225' were immediately closed when the dispensing valves 72 are closed, the pressure of the reconstituted beverage remaining in the beverage dispenser may be less than the first predetermined pressure P1.

Referring back to FIG. 2, in certain examples the beverage dispenser 10 also includes a lock-out or shut-off system 250. The lock-out system 250 advantageously prevents a reconstituted beverage with an unsafe amount of the alcoholic concentrate from being dispensed from the beverage dispenser 10. The lock-out system 250 includes the monitoring device 216 that senses the pressure or flow of the gas-infused liquid. The monitoring device 216 is in direct communication or indirect communication via the controller 116 (FIG. 5) and with a concentrate lockout device 218 (e.g., valve) such that when the controller input state(s) are 'out of product, CO2, or water' the controller 116 causes the concentrate lockout device 218 to activate (e.g., close) thereby stopping the flow of the alcoholic concentrate. In other examples, the flow turbines 214, 217 may indicate that an incorrect ratio of the gas-infused liquid and the alcoholic concentrate is being conveyed through the beverage dispenser 10 such that the controller 116 activates the concentrate lockout device 218. In certain examples, the concentrate lockout device 218 and/or the water lockout device 215 are activated when there is low or insufficient pressure or flow of the concentrate and/or the gas-infused liquid. As such, the concentrate lockout device 218 and/or the controller 116 shut down the beverage dispenser 10 or alerts the operator to the error. In certain examples, the concentrate lockout device 218 must be manually reset before the beverage dispenser 10 can dispense the reconstituted beverage. In other examples, the concentrate lockout device 218 remains activated or closed until the problem is corrected or the controller 116 is reset. In certain examples, the lockout devices 215, 218 are combined to be a single unit and may be operated by an actuator (not shown).

FIG. 5 depicts an example computing system 111 of the beverage dispenser 10. In the example shown, the system 111 includes a controller 116, which is programmable and includes a processor 112 and a memory 114. The controller 116 can be located anywhere in the system 111 and/or located remote from the system 111. The controller 116 can communicate with various components of the beverage dispenser 10 via wired and/or wireless links. Although FIG. 5 shows a single controller 116, the system 111 can include more than one controller 116. Portions of the method can be carried out by a single controller or by several separate controllers. Each controller 116 can have one or more control sections or control units. One having ordinary skill in the art will recognize that the controller 116 can have many different forms and is not limited to the example that is shown and described. For example, the controller 116 carries out the dispensing control methods for the entire system 111, but in other examples dispensing control units could be provided.

In one non-limiting example, the controller 116 communicates with one or more components of the system 111 via a communication link 113, which can be a wired or wireless link. The controller 116 is capable of monitoring and controlling one or more operational characteristics of the system 111 and its various subsystems by sending and receiving control signals via the communication link 113. The system 111 may include several modules. For example, the user interface module 119 may be connected to a remote 120, a control panel, a connection port, and/or the like. In another non-limiting example, a control module 121 such as an internet or network module may connect the dispenser to the internet. The control module 121 may be wireless or wired, and the control module 121 may allow a remote user to control the components of the dispenser. The controller 116 may further relay data to and/or receive data from the beverage dispenser 10 such as switches, valves, pumps, displays, and/or the like.

In certain examples, the gas infusion device 22, the boost pump 40, the flow turbines 214, 217, the water lockout device 215, the monitoring device 216, the concentrate lockout device 218, the pressure sensor 230, the switches 235, 235', the solenoid valves 57, and the flow sensors 58 are electrically coupled to and in communication with the controller 116. A person having ordinary skill in the art will recognize that other components, devices, and/or systems can be coupled to and controlled by the controller 116.

In certain examples, additional pressure sensors (not shown) are included with the beverage dispenser 10 to sense the pressure of the various fluids within the beverage dispenser 10. The sensors are coupled to the controller 116 via communication links 113 and configured to relay signals to the controller 116 related to the sensed pressures. In certain examples, the controller 116 is configured to determine if the pressure(s) sensed by the pressure sensor 230 and/or other sensors is above or below a predetermined pressure (e.g., a first predetermined pressure, a second predetermined pressure, a low-pressure limit, a maximum pressure) and can then open and/or close different connected components (e.g., valves, switches) thereby increase or decrease the flow of the base liquid, the gas, the gas-infused liquid, the alcoholic concentrate, and/or the reconstituted beverage.

In certain examples, the controller 116 has an indicator 37 (e.g., touchscreen panel, light, LED) to thereby indicate to the operator that the pressure of the gas and/or the base liquid is below a low-pressure limit and/or that the flow of the gas and/or the base liquid has been stopped. Based on the state of the indicator 37, the operator is alerted to inspect and/or repair the beverage dispenser 10 and/or replace the base liquid source 13 and/or the gas source 16. In certain examples, the indicator 37 which is located at the tap 70.

Figure 6:
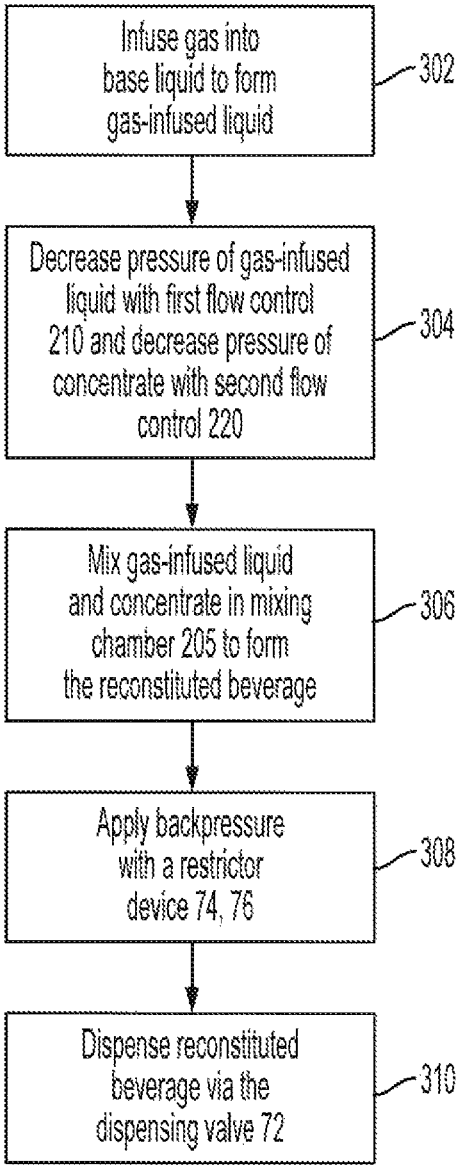
FIG. 6 is an example method for dispensing a reconstituted beverage.

Referring to FIG. 6, an example method for dispensing the reconstituted beverage is depicted (refer to FIG. 3 for components noted below). As shown at 302, the method begins with infusing the gas into the base liquid with the gas infusion device 22 to thereby form the gas-infused liquid. The gas-infused liquid is conveyed to the first flow control 210 that decreases the pressure of the gas-infused liquid and the alcoholic concentrate is conveyed to the second flow control 220 that decreases the pressure of the alcoholic concentrate (shown 304). As shown at 306, the gas-infused liquid and the alcoholic concentrate are mixed in the mixing chamber 205 to form the reconstituted beverage. The restrictor device, which may be either or both the fixed restrictor 74 and an adjustable restrictor 76, applies a backpressure on the gas-infused liquid, the alcoholic concentrate, and/or the reconstituted beverage (shown at 308). As shown at 310, the reconstituted beverage dispenses from the dispensing valve 72 to the operator.

Figure 7:
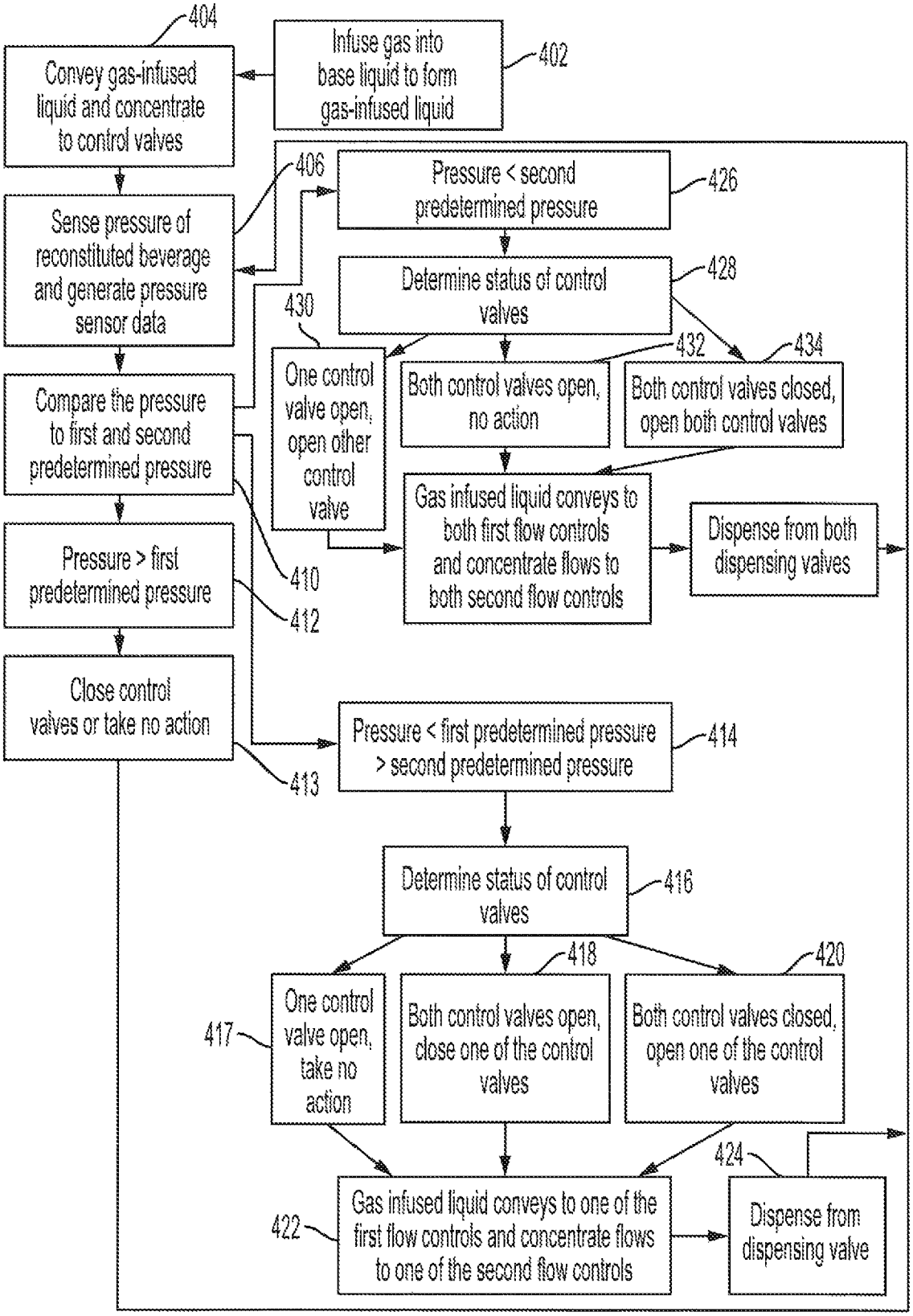
FIG. 7 is another example method for dispensing a reconstituted beverage.

Referring to FIG. 7 another example method for dispensing the reconstituted beverage is depicted (refer to FIG. 3 for components noted below). The method begins with infusing the gas into the base liquid with the gas infusion device 22 to thereby form the gas-infused liquid (shown at 402). The gas-infused liquid and the concentrate are conveyed to the first control valve 225 and the second control valve 225', as shown at 404. As shown at 406, the pressure sensor 230 senses the pressure of the reconstituted beverage in the beverage dispenser 10. The controller 116 compares the pressure to the first predetermined pressure and the second predetermined pressure (see 410) that are stored on the memory 114 (FIG. 5) of the controller 116.

As shown at 412, if the sensed pressure is greater than the first predetermined pressure the controller 116 closes the control valve 225, 225". If the controls valves 225, 225' are already closed, the controller 116 does not take any action (see 413). The method returns to sensing the pressure of the reconstituted beverage with the pressure sensor, as shown at 406.

As shown at 414, if the sensed pressure is less than the first predetermined pressure and greater than the second predetermined pressure, the controller 116 determines the status (e.g., open or closed) of the first control valve 225 and the second control valve 225' (see 416). If one of the control valves 225, 225' is open, the controller 116 takes no action and the open control valve 225, 225' remains open (see 417). If both control valves 225, 225' are open, the controller 116 closes one of the control valves 225 (see 418). If both control valves 225, 225' are closed, the controller 116 opens one of the control valves 225 (see 420). As such, the gas-infused liquid is conveyed to one of the first flow controls 210, 210' and the alcoholic concentrate is conveyed to one of the second flow controls 220, 220' (see 422). As such, the reconstituted beverage continues to dispense from the dispensing valve 72 (see 424) and the method returns to sensing the pressure of the reconstituted beverage with the pressure sensor 230, as shown at 406.

As shown at 426, if the sensed pressure is less than the second predetermined pressure, the controller 116 determines the status (e.g., open or closed) of the first control valve 225 and the second control valve 225' (see 428). If only one of the control valves 225, 225' is open, the controller 116 opens the flow control 225, 225' that is closed (see 430). If both control valves 225, 225' are open, the controller 116 takes no action (see 432). If both control valves 225, 225' are closed, the controller 116 opens both of the control valves 225, 225' (see 434). As such, the gas-infused liquid is conveyed to both first flow controls 210, 210' and the alcoholic concentrate is conveyed to both second flow controls 220, 220' (see 436). As such, the reconstituted beverage continues to dispense from both dispensing valves 72 (see 438) and the method returns to sensing the pressure of the reconstituted beverage with the pressure sensor, as shown at 406.

A person of ordinary skill in the art will recognized that the methods described herein can be combined with each other. Furthermore, the methods described herein can include additional method steps and/or exclude certain method steps that are described in other methods.

In certain example, a duplex valve is included upstream of the flow control blocks to prevent breakout of the gas from the base liquid. In certain examples, the dispensing patterns between multiple taps might cause certain flow control blocks to remain inactive for periods of time. Sanitation of the active flow control block, and the remainder of the system are necessary for food service regulations and to dispense reconstituted beverages with consistent quality. In order to clean all flow control blocks in the beverage dispenser (such as the beverage dispenser with two flow control blocks in FIG. 3) the controller is configured to periodic toggle the active flow control block between the different flow controls blocks and/or activate a cleaning sequence that operates to clean the flow controls blocks when any one or multiple taps are opened.

In certain examples, a beverage dispenser includes a gas infusion device configured to infuse a gas into a base liquid to form a gas-infused liquid, a mixing chamber configured to mix the gas-infused liquid and a concentrate to thereby form a reconstituted beverage, a first flow control configured to decrease pressure of the gas-infused liquid prior to mixing with the concentrate, and a second flow control configured to decrease pressure of the concentrate prior to mixing with the gas-infused liquid. A restrictor device downstream from the mixing chamber and configured to apply backpressure on the concentrate and the gas-infused liquid, and a dispensing valve is configured to dispense the reconstituted beverage.

In certain examples, the first flow control is configured to dispense the gas-infused liquid at a first flow rate and the second flow control is configured to dispense the concentrate at a second flow rate. In certain examples, the first flow rate is greater than the second flow rate. In certain examples, the pressure of the gas-infused liquid dispensed from the first flow control equals the pressure of the concentrate dispensed from the second flow control. In certain examples, the pressure of the gas-infused liquid received by the first flow control equals the pressure of the concentrate received by the second flow control.

In certain examples, a boost pump is configured to increase the pressure of the gas-infused liquid received by the first flow control and a pump is configured to increase the pressure of the concentrate received by the second flow control. The pressure of the gas-infused liquid received by the first flow control and the pressure of the concentrate received by the second flow control is 60.0 pounds per square inch. In certain examples, the restrictor device is adjustable to thereby adjust the backpressure applied on the concentrate and the gas-infused liquid. In certain examples, the restrictor device is adjusted until the pressure decrease of the gas-infused liquid through the first flow control equals the pressure decrease of the concentrate through the second flow control.

In certain examples, a first control valve configured to dispense the gas-infused liquid to the first flow control and the concentrate to the second flow control, a second control valve configured to dispense the gas-infused liquid to a third flow control and the concentrate to a fourth flow control. The third flow control is configured to decrease pressure of the gas-infused liquid prior to mixing with the concentrate and the fourth flow control is configured to decrease pressure of the concentrate prior to mixing with the gas-infused liquid. A second restrictor device configured to apply backpressure on the concentrate and the gas-infused liquid. A second dispensing valve configured to dispense the reconstituted beverage. The gas-infused liquid dispensed from the first flow control and the third flow control mix with the concentrate dispensed from the second flow control and the fourth flow control to thereby form the reconstituted beverage. In certain examples, when both the first dispensing valve and the second dispensing valve are opened the first control valve opens and thereby dispenses the gas-infused liquid to the first flow control and the concentrate to the second flow control and the second control valve opens and thereby dispenses the gas-infused liquid to the third flow control and the concentrate to the fourth flow control. In certain examples, a pressure sensor that senses pressure of the reconstituted beverage and a controller is configured to receive signals from the pressure sensor that correspond to the pressure of the reconstituted beverage. When the pressure of the reconstituted beverage is less than a first predetermined pressure and greater than a second predetermined pressure, the controller opens one of the first control valve and the second control valve, and when pressure of the reconstituted beverage is less than the second predetermined pressure, the controller opens both of the first control valve and the second control valve. In certain examples, when the pressure of the reconstituted beverage is equal to or greater than the first predetermined pressure, the controller closes both the first control valve and the second control valve.

In certain examples, a method of dispensing a reconstituted beverage includes the steps of: infusing a gas into a base liquid to thereby form a gas-infused liquid; mixing, in a mixing chamber, the gas-infused liquid and a concentrate to thereby form a reconstituted beverage; decreasing, with a first flow control, pressure of the gas-infused liquid prior to the mixing of the gas-infused liquid and the concentrate; decreasing, with a second flow control, the pressure of the concentrate prior to the mixing of the gas-infused liquid and the concentrate; applying, with a first restrictor device positioned downstream from the mixing chamber, backpressure on the concentrate and the gas-infused liquid; and dispensing the reconstituted beverage via a first dispensing valve. In certain examples, the method includes the steps of increasing the pressure of the gas-infused liquid received by the first flow control, increasing the pressure of the concentrate received by the second flow control, and/or adjusting the first restrictor device such that the backpressure applied on the concentrate and the gas-infused liquid is adjusted and the pressure decrease of the concentrate through the first flow control equals the pressure decrease of the concentrate through the second flow control. In certain examples, the pressure of the gas-infused liquid received by the first flow control equals the pressure of the concentrate received by the second flow control and the pressure of the gas-infused liquid dispensed from the first flow control equals the pressure of the concentrate dispensed from the second flow control.

In certain examples, the method can include the steps of dispensing, with a first control valve, the gas-infused liquid to the first flow control and the concentrate to the second flow control; dispensing, with a second control valve, the gas-infused liquid to a third flow control and the concentrate to a fourth flow control; decreasing, with the third flow control, pressure of the gas-infused liquid prior to the mixing of the gas-infused liquid and the concentrate; decreasing, with the fourth flow control, the pressure of the concentrate prior to the mixing of the gas-infused liquid and the concentrate; applying, with a second restrictor device positioned downstream from the mixing chamber, backpressure on the concentrate and the gas-infused liquid; dispensing the reconstituted beverage via the first dispensing valve and a second dispensing valve; sensing pressure of the reconstituted beverage; opening the first control valve when the pressure of the reconstituted beverage is less than a first predetermined pressure and greater than a second predetermined pressure; and opening the first control valve and the second control valve when the pressure is less than the second predetermined pressure. In certain examples, the gas-infused liquid from the first flow control and the third flow control mix with the concentrate from the second flow control and the fourth flow control to form the reconstituted beverage.

In the present description, certain terms have been used for brevity, clarity, and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage dispenser comprising:

a mixing chamber in which a gas-infused liquid and a concentrate are mixed to form a reconstituted beverage;

a first flow control device configured to decrease pressure of the gas-infused liquid before the gas-infused liquid and the concentrate are mixed;

a restrictor device configured to decrease pressure of the reconstituted beverage;

a dispensing valve configured to dispense the reconstituted beverage; and a second flow control device configured to decrease pressure of the concentrate before the gas-infused liquid and the concentrate are mixed.

2. The beverage dispenser according to claim 1, wherein the first flow control is configured to dispense the gas-infused liquid at a first flow rate and the second flow control is configured to dispense the concentrate at a second flow rate that is less than the first flow rate such that the reconstituted beverage has a predetermined fluid ratio.

3. The beverage dispenser according to claim 1, further comprising a pump configured to increase pressure of the one of the gas-infused liquid and the concentrate before the flow control device decreases the pressure of the one of the gas-infused liquid and the concentrate.

4. The beverage dispenser according to claim 1, further comprising a lock-out system configured to stop flow of the concentrate when the pressure of the gas-infused liquid is less than a minimum pressure and prevent the reconstituted beverage from being dispensed with an unsafe amount of the concentrate.

5. The beverage dispenser according to claim 4, wherein the lock-out system has a sensor that senses the pressure of the gas-infused liquid, and further comprising:

a lockout device configured to selectively stop the flow of the concentrate; and a controller that receives signals from the sensor and controls the lockout device based on the signals from the sensor.

6. A beverage dispenser comprising:

a mixing chamber in which a gas-infused liquid and a concentrate are mixed to form a reconstituted beverage;

a flow control device configured to decrease pressure of one of the gas-infused liquid and the concentrate before the gas-infused liquid and the concentrate are mixed;

a restrictor device configured to decrease pressure of the reconstituted beverage; and a dispensing valve configured to dispense the reconstituted beverage;

wherein when the gas-infused liquid and the concentrate are mixed, pressure of the concentrate equals pressure of the gas-infused liquid.

7. The beverage dispenser of claim 6, further comprising a lock-out system configured to stop flow of the concentrate when the pressure of the gas-infused liquid is less than a minimum pressure and prevent the reconstituted beverage from being dispensed with an unsafe amount of the concentrate.

8. A beverage dispenser comprising:

a mixing chamber in which a gas-infused liquid and a concentrate are mixed to form a reconstituted beverage;

a flow control device configured to decrease pressure of one of the gas-infused liquid and the concentrate before the gas-infused liquid and the concentrate are mixed;

a restrictor device configured to decrease pressure of the reconstituted beverage, wherein the restrictor device is adjustable to thereby change the pressure of the reconstituted beverage; and a dispensing valve configured to dispense the reconstituted beverage.

9. The beverage dispenser of claim 8, further comprising a lock-out system configured to stop flow of the concentrate when the pressure of the gas-infused liquid is less than a minimum pressure and prevent the reconstituted beverage from being dispensed with an unsafe amount of the concentrate.

10. The beverage dispenser of claim 8 further comprising a pump configured to increase pressure of the one of the gas-infused liquid and the concentrate before the flow control device decreases the pressure of the one of the gas-infused liquid and the concentrate.

11. A beverage dispenser comprising:

a mixing chamber in which a gas-infused liquid and a concentrate are mixed to form a reconstituted beverage;

a first flow control device configured to decrease pressure of the gas-infused liquid before the gas-infused liquid and the concentrate are mixed;

a second flow control device configured to decrease pressure of the concentrate before the gas-infused liquid and the concentrate are mixed;

a pump configured to increase the pressure of the one of the gas-infused liquid and the concentrate before the flow control device decreases the pressure of the one of the gas-infused liquid and the concentrate such that the flow control device properly dispenses the one of the gas-infused liquid and the concentrate at the first flow rate and the reconstituted beverage is properly formed; and a dispensing valve configured to dispense the reconstituted beverage.

12. The beverage dispenser according to claim 11, wherein the pump is a first pump configured to increase the pressure of the gas-infused liquid before the first flow control device decreases the pressure of the gas-infused liquid such that the first flow control device dispenses the gas-infused liquid at a first flow rate;

and further comprising:

a second pump configured to increase the pressure of the concentrate before the second flow control device decreases the pressure of the concentrate such that the second flow control device dispenses the concentrate at a second flow rate.

13. The beverage dispenser according to claim 12, wherein the second flow rate is less than the first flow rate such that the reconstituted beverage has a predetermined fluid ratio.

14. The beverage dispenser according to claim 11, wherein the first flow control is configured to dispense the gas-infused liquid at a first flow rate and the second flow control is configured to dispense the concentrate at a second flow rate that is less than the first flow rate such that the reconstituted beverage has a predetermined fluid ratio.

15. The beverage dispenser according to claim 11, further comprising a restrictor device configured to decrease pressure of the reconstituted beverage.

16. The beverage dispenser according to claim 11, further comprising a lock-out system configured to stop flow of the concentrate when the pressure of the gas-infused liquid is less than a minimum pressure and thereby prevent the reconstituted beverage from being dispensed with an unsafe amount of the concentrate.

17. The beverage dispenser according to claim 16, wherein the lock-out system has a sensor that senses the pressure of the gas-infused liquid, and further comprising:

a lockout device configured to selectively stop flow of the concentrate; and a controller that receives signals from the sensor and controls the lockout device based on the signals from the sensor.

18. A beverage dispenser comprising:

a mixing chamber in which a gas-infused liquid and a concentrate are mixed to form a reconstituted beverage;

a flow control device configured to decrease pressure of one of the gas-infused liquid and the concentrate before the gas-infused liquid and the concentrate are mixed such that the one of the gas-infused liquid and the concentrate is dispensed at a first flow rate;

a pump configured to increase the pressure of the one of the gas-infused liquid and the concentrate before the flow control device decreases the pressure of the one of the gas-infused liquid and the concentrate such that the flow control device properly dispenses the one of the gas-infused liquid and the concentrate at the first flow rate and the reconstituted beverage is properly formed;

a restrictor device configured to decrease pressure of the reconstituted beverage, wherein the restrictor device is adjustable to thereby change the pressure of the reconstituted beverage; and a dispensing valve configured to dispense the reconstituted beverage.

19. The beverage dispenser of claim 18, further comprising a lock-out system configured to stop flow of the concentrate when the pressure of the gas-infused liquid is less than a minimum pressure and thereby prevent the reconstituted beverage from being dispensed with an unsafe amount of the concentrate.

20. The beverage dispenser according to claim 19, wherein the lock-out system has a sensor that senses the pressure of the gas-infused liquid, and further comprising:

a lockout device configured to selectively stop flow of the concentrate; and a controller that receives signals from the sensor and controls the lockout device based on the signals from the sensor.

* * * * *